US005343595A

United States Patent [19]

Lautenschläger

[11] Patent Number: 5,343,595

[45] Date of Patent: Sep. 6, 1994

[54] MOUNTING PLATE FOR FURNITURE HINGES

[75] Inventor: Gerhard W. Lautenschläger, Brensbach-Wersau, Fed. Rep. of Germany

[73] Assignee: Mepla-Werke Lautenschläger GmbH & Co. KG, Reinheim, Fed. Rep. of Germany

[21] Appl. No.: 957,226

[22] Filed: Oct. 6, 1992

[30] Foreign Application Priority Data

Oct. 7, 1991 [DE] Fed. Rep. of Germany ... 9112453[U]

[51] Int. Cl.[5] ..... E05D 7/10

[52] U.S. Cl. ..... 16/257

[58] Field of Search ..... 16/257, 271, 272, DIG. 43

[56] References Cited

U.S. PATENT DOCUMENTS

| | | | |
|---|---|---|---|
| 4,430,771 | 2/1984 | Salice | 16/257 |
| 4,731,903 | 3/1988 | Kennedy et al. | 16/257 |
| 4,817,237 | 4/1989 | Murphy | 16/257 |
| 4,839,940 | 6/1989 | Grass | 16/DIG. 43 |
| 5,054,164 | 10/1991 | Blanco-Equiluz | 16/DIG. 43 |

FOREIGN PATENT DOCUMENTS

| | | | |
|---|---|---|---|
| 340274 | 12/1977 | Austria . | |
| 0043903 | 1/1982 | European Pat. Off. . | |
| 7517704 | 6/1975 | Fed. Rep. of Germany . | |
| 7535818 | 11/1975 | Fed. Rep. of Germany . | |
| 3516683 | 11/1986 | Fed. Rep. of Germany | 16/257 |
| 3538888 | 5/1987 | Fed. Rep. of Germany . | |
| 3711064 | 10/1988 | Fed. Rep. of Germany . | |
| 3939080 | 5/1990 | Fed. Rep. of Germany . | |
| 3126614 | 5/1991 | Fed. Rep. of Germany . | |

*Primary Examiner*—P. Austin Bradley
*Assistant Examiner*—Chuck Y. Mah

[57] ABSTRACT

Mounting plate (10) composed of an upper portion and a lower portion for adjustably securing the support wall abutment portion of a furniture hinge to the support wall of a cupboard carcass in which the mounting plate lower portion (12) may be secured directly to the support wall and the mounting plate upper portion (14) is slidable parallel to the support wall onto the mounting plate lower portion through a sliding guide defined between the portions from the interior of the carcass in the direction out of the cupboard carcass until in engagement with abutments which come into engagement with one another in the predetermined end position secured against lifting away from the mounting plate lower portion.

14 Claims, 2 Drawing Sheets

MOUNTING PLATE FOR FURNITURE HINGES

The invention relates to a mounting plate composed of an upper portion and a lower portion for adjustably securing the support wall abutment portion of a furniture hinge to the support wall of a cupboard carcass in which the mounting plate lower portion may be secured directly to the support wall and the mounting plate upper portion is slidable onto the mounting plate lower portion parallel to the support wall through a sliding guide defined between the portions from the inferior of the carcass in the direction out of the cupboard carcass until it engages abutments which come into engagement with one another in the predetermined end position secured against lifting away of the mounting plate lower portion.

A mounting plate of this type is known (DE-A 3339706) in which the lower portion manufactured of plastics material has two fastening pegs which are connected together by a web to form an integral unit and by means of which the lower portion may be fastened in associated fastening bores in the cupboard carcass. The connecting web for its part may be slid in a recess, which is open to the fastening surface, in the upper portion which is made of metal. This upper portion, which alone is visible after assembly, thus constitutes the actual mounting plate, i.e. which adjustably holds the support arm of an associated hinge. The fixing of the two portions in the predetermined assembled position is effected by abutments on the one hand and a screw on the other hand, whereby a fastening or adjustment screw, which is in any event necessary for the fastening or adjustment of the hinge support arm, is used—so to speak with the additional function of a connecting screw. The integral fabrication of the fastening pegs together with a connecting web and the mounting on the mounting plate upper portion by a sliding connection in the upper portion achieves a simplification of the assembly of plastics fastening pegs on metallic mounting plates which up till now had to be separately manufactured and individually screwed to the metallic mounting plate. Furthermore, the replacement of the metallic upper portion of the known mounting plate after its assembly by another upper portion by sliding the lower portion away and sliding the new upper portion onto the lower portion mounted on the cupboard carcass was contemplated even if the known mounting plate is to be preassembled from its two portions and mounted as a unit on the cupboard carcass. The disassembly of the upper portion of the mounting plate mounted on the cupboard carcass requires the unscrewing of the screw securing the portions against displacement and accordingly the new upper portion slid onto the lower portion must again be secured by tightening the screw in question which is of course labour intensive and thus also in the special case requires care because the screw —as mentioned—also has adjustment and fastening functions for the hinge itself.

With this background, it is the object of the invention so to develop the known mounting plate that the assembly of the upper portion onto the lower portion can be effected exclusively by sliding the upper portion onto the lower portion without additional fastening by means of a screw being necessary, whereby the disassembly—if necessary—is also to be very simple and rapidly possible.

Starting from a mounting plate of the type referred to above this object is solved in accordance with the invention if the mounting plate lower portion has a resilient tongue which is directed substantially out of the cupboard carcass and whose free end projects beyond the upper surface of the mounting plate lower portion, if provided on the lower surface of the mounting plate upper portion directed towards the mounting plate lower portion there is a recess which is defined at its outer end by a transversely extending locking edge and if the free end of the resilient tongue and the locking edge on the mounting plate upper portion are so arranged that the free end of the resilient tongue springs into the recess in the predetermined end position of the mounting plate upper portion on the mounting plate lower portion and engages the locking edge. It is thus possible to premount the mounting plate lower portions onto the support walls of articles of furniture and to slide the separate upper portions rapidly and simply onto the lower portions, if this is necessary. That is to say for the purpose of transport or despatch of an unassembled article of furniture the support walls provided with the premounted lower portions can be assembled in a space-saving manner into packets in close engagement. The premounting of the whole mounting plates, on the other hand, would result in more voluminous transport units because—corresponding to the greater height of the mounting plates—the support walls could not be packed so tightly and furthermore the scratching of the surface of adjacent cupboard walls by the metallic upper portions would have to be prevented by additional separators.

In a preferred embodiment of the invention the mounting plate upper portion has an opening above the recess which renders it possible to push the resilient tongue back out of the recess in the upper portion so that the upper portion—if necessary—may also simply be slid away from the lower portion again.

If the mounting plate upper portion has the shape of an elongate bar-like mounting web to match the commonly used furniture hinges with an elongate support arm as the support wall abutment member, the construction can be such in a convenient embodiment of the invention that the mounting web has narrow edge strips directed outwardly at right-angles at its lower side edges on the support wall side and that the mounting plate lower portion is provided with two elongate, bar-like projections which fittingly receive the upper portion between them and in whose side surfaces directed towards the lateral cheeks of the mounting web a respective open elongate groove is provided which fittingly receives the associated edge strip.

The grooves are conveniently open at their rear ends in the interior of the carcass in the end faces of the bar-like projections but are closed at their front end so that the closed end of the groove and the front end faces of the edge strips thus form abutments.

The mounting plate lower portion is preferably an integral injection moulded plastics component including the resilient spring, whereby the mounting plate lower portion—corresponding to the known mounting plate—has at least one fastening peg which projects from its lower surface and may be inserted, driven or pressed into a respective bore in the support wall of an article of furniture. The or a part of the or all fastening pegs can be oversized with respect to the respective associated bore in the support wall. Alternatively, the or a portion of the or all the fastening pegs can be expansible in the manner of a straddling dowel, whereby the fastening peg(s) is or are conveniently provided in a known manner with retaining ridges which extend substantially in the peripheral direction and are pointed in the manner of saw teeth in cross-section.

The mounting plate lower portion conveniently has the shape of a low fastening plate from whose upper portion the bar-like projections project.

It can be convenient, if, at its rear end in the interior of the carcass, the mounting plate upper portion has at least one abutment which projects downwardly and in the predetermined fastened position comes into engagement with the mounting plate lower portion in its rear end region. This abutment can thus—so to speak as additional security—supplement the abutments formed by the front end faces of the edge strips on the upper portion and the closed ends of the grooves or even replace them.

The metallic upper portion can either be a cast member manufactured from metal in a die casting method or—preferably—a thin walled plate member manufactured from metal plate in a stamping-pressing method which then conveniently has a U-shaped cross-section, whereby the edge strips holding it in the lower portion are then formed by material strips bent over at right-angles from the free ends of the U-shaped cross-section.

In order then to secure the thus constructed upper portion in the predetermined fastened position on the lower portion against displacement in the transverse direction it can be convenient to construct upwardly projecting engagement surfaces in the end region at the exterior of the carcass of the mounting plate lower portion between the elongate, bar-shaped projections, which surfaces engage the inner surfaces of the lateral cheeks of the upper portion in the predetermined assembled position of the upper and lower portions.

The invention will be described in more detail in the following description of an exemplary embodiment in conjunction with the drawings, in which.

Figure 1:
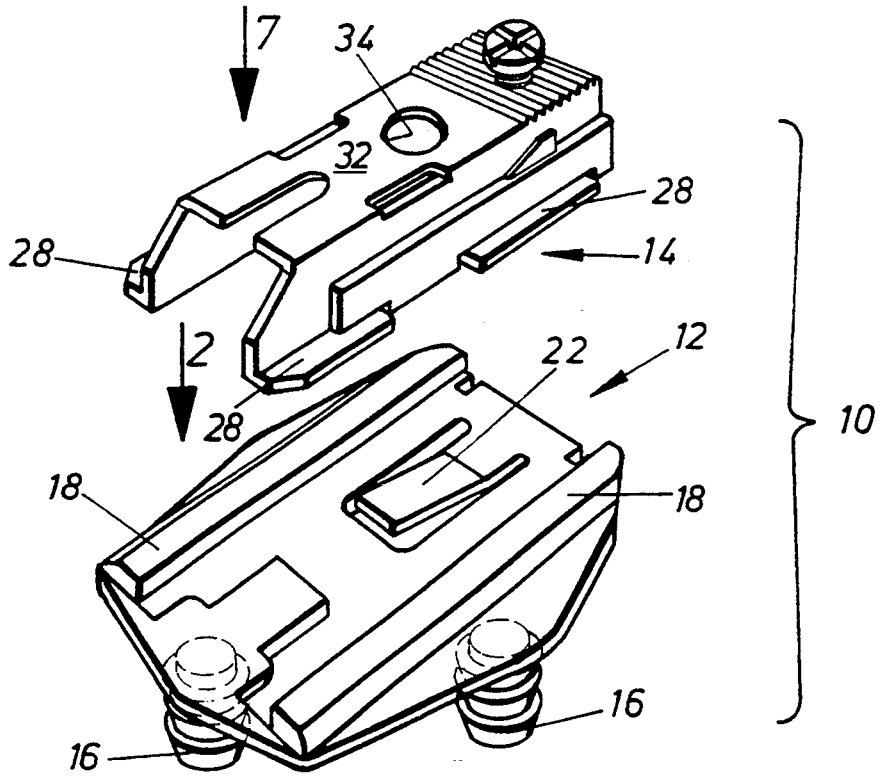
FIG. 1 is a perspective view in the form of an exploded drawing of the mounting plate in accordance with the invention.
Figure 2:
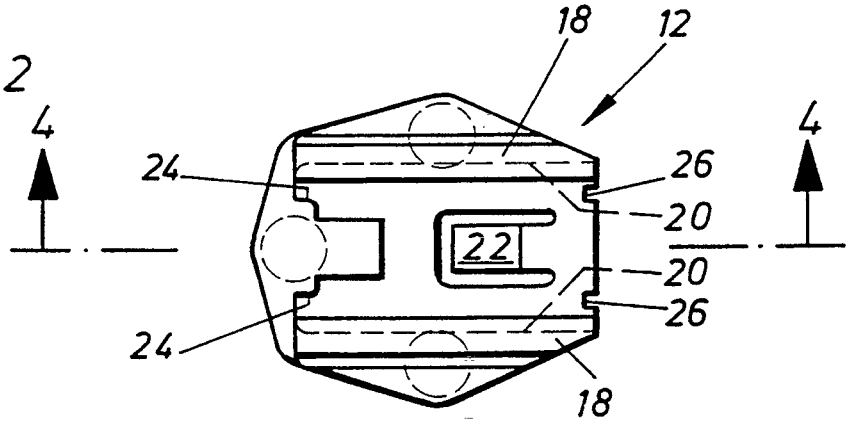
FIG. 2 is a plan view of the lower portion of the mounting plate in accordance with the invention seen in the direction of the arrow 2 in FIG. 1.
Figure 3:
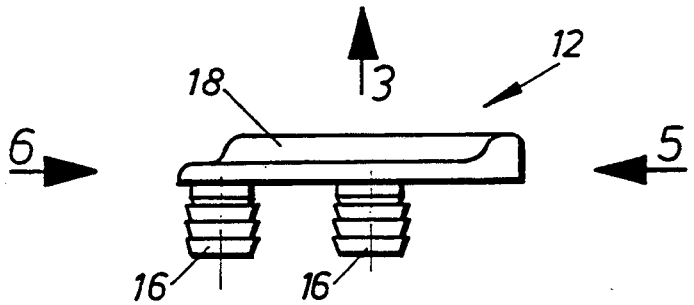
FIG. 3 is an elevation of the lower portion seen in the direction of the arrow 3 in FIG. 2.
Figure 4:
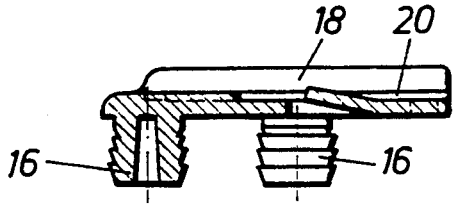
FIG. 4 is a sectional elevation of the mounting plate lower portion along the line 4—4 in FIG. 2.
Figure 5:
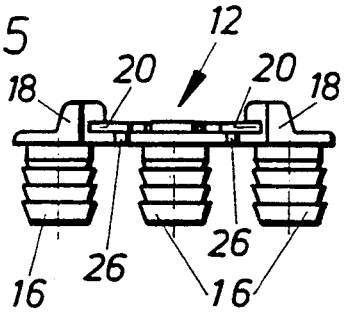
FIG. 5 is an elevation of the mounting plate lower portion in the direction of the arrow 5 in FIG. 3.
Figure 6:
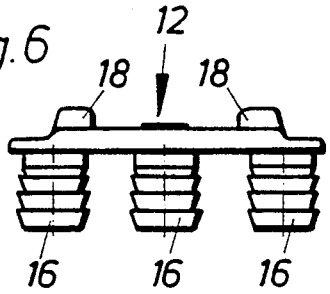
FIG. 6 is an elevation of the lower portion seen in the direction of the arrow 6 in FIG. 3.

As may be seen in FIG. 1, the mounting plate which is designated as a whole with 10 is composed of a lower portion 12, which is shown separately in FIGS. 2 to 6 and which may be secured directly to the support wall of a cupboard carcass (not shown), and an upper portion 14 which is releasably secured to the lower portion 10 and which is separately shown in FIGS. 7 to 11. The lower portion 12 which is constructed as an integral injection moulded plastics member, has—in the illustrated case—the shape of a low fastening plate, from whose underside directed towards the support wall project three fastening pegs 16 arranged in a triangle which are constructed in the conventional manner as driving-in pegs provided with retaining ridges of saw tooth shaped cross-section. Grooves 20 machined into the lateral surfaces directed towards one another of two parallel, elongate, bar-like projections 18 projecting from the upper surface of the lower portion 12 constitute part of a sliding guide by means of which the upper portion may be slid onto the lower portion and may be fixed in the predetermined assembled position. Cut out of the plate-shaped region between the bar-like projections is a resilient tongue 22 whose free end extends above the upper surface of the plate-shaped region but may be pushed back resiliently into a plane in alignment with this plate-shaped region. The free end of the tongue 22, which constitutes a locking edge, is directed out of the interior of the cupboard carcass in the predetermined fastened position of the lower portion 12 to the support wall of a cupboard carcass. In the end region at the exterior of the carcass the grooves 20 formed in the bar-like projections 18 are closed and furthermore the end of the mounting plate at the exterior of the carcass is of somewhat increased height with respect to the rear plate-shaped region, whereby this increase in height extends a bit into the interior of the plate-shaped region in the manner of a tongue. The mounting plate is thus stronger in this region and a fastening peg 16 attached to the opposite undersurface can thus transmit correspondingly larger retaining forces to the mounting plate. The lateral breadth of this tongue-like increase in height is so selected in the front end region that it forms lateral abutment surfaces 24 on opposing sides which, in the predetermined fastened position of the upper portion on the lower portion, engage the inner surfaces of the lateral cheeks of the upper portion 14 and thus secure it against lateral deformation. The same purpose is served by notches 26 (FIGS. 2 and 5) which are provided in the end in the interior of the carcass of the plate-shaped region of the lower portion 12 and in which downwardly projecting projections at the end in the interior of the carcass of the lateral cheeks of the upper portion 14 engage in the predetermined fastened position of the upper portion 14 on the lower portion 12.

The upper portion, which is separately illustrated in FIGS. 7 to 11, is in this special case a sheet metal member manufactured from sheet metal plate which was originally flat in a stamping-pressing process which has the shape of an elongate bar-like mounting flange with an inverted U-shaped cross-section, narrow edge strips 28 directed outwardly at right-angles being bent out from the lower side edges on the support wall side of the mounting flange, which strips engage in the respective associated groove 20 in the lower portion 12. Since these grooves 20 are open at their rear end in the interior of the carcass but are closed at their front end, the upper portion can be slid from the rear end onto the lower portion until the front edges of the edge strips 28 abut against the closed end of the grooves 20.

The resilient spring 22, which was described above, on the lower portion extends between the lateral cheeks of the upper portion which, in the region of the free end of the tongue, has two laterally inwardly bent over flanges 30 which initially force the resilient tongue resiliently downwardly when the upper portion is slid onto the lower portion. As soon as the upper portion has reached the predetermined fastened position, the free end of the tongue 22 is situated directly behind the rear transverse edges of the flanges 30 and springs upwardly and locks the upper portion against being withdrawn from the lower portion.

Figure 7:
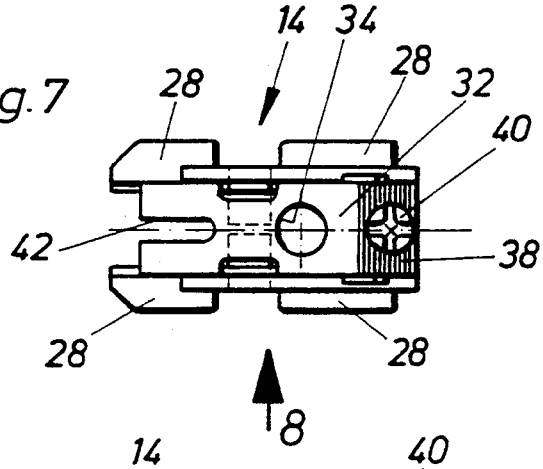
FIG. 7 is a plan view of the mounting plate upper portion seen in the direction of the arrow 7 in FIG. 1.
Figure 8:
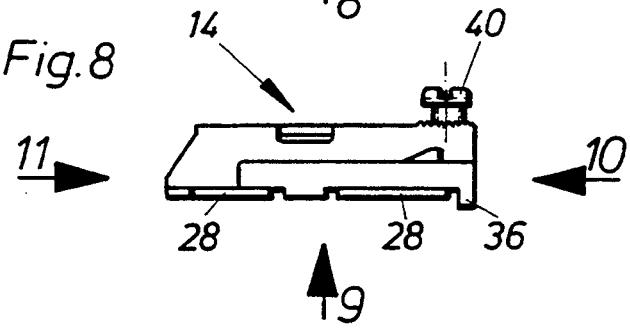
FIG. 8 is a side view of the upper portion seen in the direction of the arrow 8 in FIG. 7.
Figure 10:
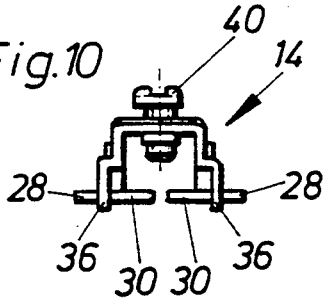
FIG. 10 is an elevation seen in the direction of the arrow 10 in FIG. 8.
Figure 9:
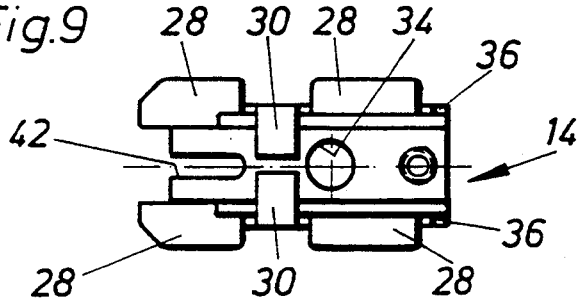
FIG. 9 is an underneath view of the mounting plate upper portion seen in the direction of the arrow 9 in FIG. 8.
Figure 11:
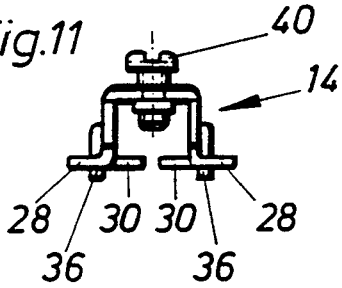
FIG. 11 is an elevation of the mounting plate upper portion seen in the direction of the arrow 11 in FIG. 8.

In order, if necessary, to render disassembly possible by unlocking the tongue from the flanges 30, an opening 34, in the form of the circular stamping which may be seen in particular in FIGS. 1, 7 and 9, is provided in the upper bar surface of the upper portion 14, through which hole a shaft-shaped tool can be inserted with which the tongue is forced into the unlocked position.

At the rear end of the lateral cheeks of the upper portion short lugs 36 also project to below the undersurface of the edge strips 28 which, in the predetermined fastened position of the upper portion on the lower portion, engage in the notches 26.

In other respects the elongate bar-like mounting flange of the upper portion is constructed in a manner corresponding to the normal mounting plates, i.e. in the rear portion it has the fastening screw 40 screwed into a threaded bore in a fastening section provided with transverse grooves 38 whilst provided in the front region of the flange surface 32 there is a forwardly open elongate hole 42 which serves to accommodate a mounting head (not shown) provided on the support arm of an associated hinge. The nature and details of the fastening and adjusting means holding the hinge support arm on the mounting plate are not of importance to the present invention and can differ from the means illustrated in the special exemplary embodiment. The upper portion need also not necessarily be fabricated from metal plate in a stamping-pressing process but can also be constructed as a metallic die cast component.

I claim:

1. A mounting plate composed of an upper portion and a lower portion for adjustably securing a support wall abutment portion of a furniture hinge to a support wall of a carcass in which the mounting Upper portion is slidable from a rear end of the lower portion onto the mounting plate lower portion along a sliding guide defined between the portions, said upper portion of said mounting plate being held in a predetermined assembled position such as to prevent a lifting away of the upper portion of the predetermined assembled position on the mounting plate lower portion in the region situated below the mounting plate upper portion (14) in the predetermined assembled position, the mounting plate lower portion (12) has a resilient tongue (22) which is directed opposite to an interior end of the lower portion and said tongue having a free end which projects beyond an upper surface of the mounting plate lower portion (12), said mounting plate upper portion (14) having a lower surface which is directed towards the mounting plate lower portion (12), and said lower surface having a recess, said recess having arranged a transversely extending locking edge and, said free end of the resilient tongue (22) and said locking edge on the mounting plate upper portion (14) being positionable such that the free end of the resilient tongue (22) inserted into the recess in the predetermined assembled position of the mounting plate upper portion (14) on the mounting plate lower portion (12) engages the locking edge, the mounting plate upper portion (14) is made of stamp-pressed metal plate and has an inverted U-shaped cross-section having lateral cheeks with free ends and edge strips (28), said strips are bent out at right-angles from said free ends of said lateral cheeks, and the mounting plate lower portion (12) is provided with two elongate, bar-like projections (18) which accommodate the upper portion (14) fittingly between said two elongate, bar-like projections (18), said elongate, bar-like projections having side surfaces which are directed towards the lateral cheeks of a mounting web and said side surfaces having a respective elongate groove (20) which is open and fittingly accommodates one of the edge strips associated therewith (28).

2. Mounting plate as claimed in claim 1, wherein the resilient tongue (22) is an integral injection moulded plastics component.

3. The mounting plate according to claim 1, wherein the elongate grooves (20) are open at one end and closed at the other end.

4. The mounting plate according to claim 1, wherein the resilient tongue (22) is an integral part of the mounting plate lower portion (12).

5. The mounting plate according to claim 4, wherein the mounting plate lower portion (12) including the resilient tongue (22) which is an integral injection moulded plastics component.

6. The mounting plate according to claim 5, wherein the mounting plate lower portion (12) has at least one fastening peg (16) which projects from a lower surface therein.

7. The mounting plate as claimed in claim 6, wherein at least a portion of at least one of the fastening pegs (16) is oversized with respect to a respective associated bore in the support wall.

8. The mounting plate according to claim 6, wherein at least a portion of at least one of the fastening pegs (16) is expandable as a straddling dowel expands.

9. The mounting plate according to claim 6, wherein said at least one fastening peg (16) is provided with retaining ridges which extend substantially in the peripheral direction and are pointed in cross-section in the manner of saw teeth.

10. The mounting plate according to claim 1, wherein the resilient tongue (22) is manufactured separately and is secured to the mounting plate lower portion (12).

11. The mounting plate according to claim 1, wherein said mounting plate lower portion (12) is shaped to serve as a low fastening plate and said low fastening plate having an upper surface, and said bar-like projections (18) projecting from said upper surface.

12. The mounting plate according to claim 1, wherein a rear end of the mounting plate upper portion (14) has at least one abutment which projects downwardly and comes into engagement in the predetermined assembled position with the mounting plate lower portion (12) in a mounting plate lower portion's rear end region.

13. The mounting plate according to claim 1, wherein in a front end region of the mounting plate lower portion (12) between the elongate bar-shaped projections (18) there are constructed upwardly projecting engagement surfaces (24) which engage the inner surfaces of said lateral cheeks of the upper portion (14) in the predetermined assembled position of the upper and lower portions.

14. The mounting plate according to 13, wherein the locking edge on the upper portion is defined by two flanges (30) cut at the free edges of the lateral cheeks of the upper portion and which are bent inwardly substantially at right-angles thereto.

* * * * *